US008870325B2

(12) United States Patent
Mardilovich et al.

(10) Patent No.: US 8,870,325 B2
(45) Date of Patent: Oct. 28, 2014

(54) COMPENSATING FOR CAPACITANCE CHANGES IN PIEZOELECTRIC PRINTHEAD ELEMENTS

(75) Inventors: Peter Mardilovich, Corvallis, OR (US); Jack Lavier, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 13/985,757

(22) PCT Filed: Apr. 28, 2011

(86) PCT No.: PCT/US2011/034325

§ 371 (c)(1), (2), (4) Date: Aug. 15, 2013

(87) PCT Pub. No.: WO2012/148399

PCT Pub. Date: Nov. 1, 2012

(65) Prior Publication Data

US 2013/0321507 A1 Dec. 5, 2013

(51) Int. Cl.
*B41J 2/045* (2006.01)

(52) U.S. Cl.
CPC ..... *B41J 2/04581* (2013.01); *B41J 2/04508* (2013.01); *B41J 2/04573* (2013.01); *B41J 2/04588* (2013.01)
USPC ..... 347/14; 347/50; 347/58

(58) Field of Classification Search
CPC ..... B41J 2/04541; B41J 2/04581; B41J 2002/14491; B41J 2/04548; B41J 2/0457; B41J 2/14201
USPC ..... 347/9, 14, 50, 58, 68; 310/316
See application file for complete search history.

(56) References Cited

U.S. PATENT DOCUMENTS

| | | | | |
|---|---|---|---|---|
| 6,147,433 | A | 11/2000 | Reineke et al. | |
| 6,276,772 | B1 | 8/2001 | Sakata et al. | |
| 6,817,691 | B2 * | 11/2004 | Umeda | 347/9 |
| 7,661,799 | B2 * | 2/2010 | Kubo et al. | 347/58 |
| 2008/0136859 | A1 | 6/2008 | Kim et al. | |
| 2008/0170091 | A1 | 7/2008 | Ito | |
| 2008/0211847 | A1 | 9/2008 | Shamoun | |
| 2009/0301550 | A1 | 12/2009 | Hunt et al. | |
| 2010/0079553 | A1 | 4/2010 | Katoh | |

FOREIGN PATENT DOCUMENTS

| | | |
|---|---|---|
| KR | 20040082687 | 9/2004 |
| KR | 20100130415 | 12/2010 |

* cited by examiner

*Primary Examiner* — Thinh Nguyen

(57) ABSTRACT

In an embodiment, a method of compensating for capacitance change in a piezoelectric element of a fluid ejection device includes sensing a current driving a piezoelectric element, determining from the current that capacitance of the piezoelectric element has changed, and altering a rise time of the current driving the piezoelectric element to compensate for the changed capacitance.

18 Claims, 5 Drawing Sheets

| Legend | | |
|---|---|---|
| C1,C2 | — — — | Current through Cpiezo-element 210 |
| V1,V2 | - - - - - - | Voltage across Cpiezo-element 210 |

COMPENSATING FOR CAPACITANCE CHANGES IN PIEZOELECTRIC PRINTHEAD ELEMENTS

BACKGROUND

An inkjet printing device is an example of a fluid ejection device that provides drop-on-demand ejection of fluid droplets. A piezoelectric inkjet printer, for example, uses a fluid ejection assembly (i.e., printhead) with a piezoelectric material actuator or element to force fluid droplets out of a nozzle toward a print medium, such as a sheet of paper, to print an image onto the print medium. More specifically, a piezoelectric material actuator includes a flexible piezoelectric material sheet that deforms in response to an applied electric field, generating pressure pulses inside a fluid-filled chamber to eject fluid droplets. Because piezoelectric actuators use pressure instead of heat (e.g., as in the case of thermal resistor actuators) to eject fluid droplets from inkjet nozzles, piezo-based fluid ejection assemblies can accommodate a wide selection of jetable materials.

However, while heat does not limit the use of jetable materials in piezo-based printheads, temperature sensitivity in such printheads remains an issue. For example, short term changes in temperature can cause changes in both fluid drop weight and velocity. More specifically, as temperature increases during a print job, the capacitance of the piezoelectric element increases. Because the driving voltage is typically fixed, the current increases, which heats the piezo-element and the fluid (ink). The increasing ink temperature reduces viscosity at the same time the increasing capacitance strengthens the piezo-element pumping performance. The two effects result in an open-loop system in which drop weight and drop velocity continue to increase, adversely affecting printer performance.

In addition to short term temperature sensitivity issues, longer term degradation can reduce the capacitance of piezo-elements in piezoelectric printheads, resulting in non-uniform performance of the piezo-elements over time. Such degradation can often be seen in non-uniform print patterns that develop in the printed output of piezoelectric inkjet printers over time.

BRIEF DESCRIPTION OF THE DRAWINGS

The present embodiments will now be described, by way of example, with reference to the accompanying drawings, in which.

DETAILED DESCRIPTION

Overview

Figure 1:
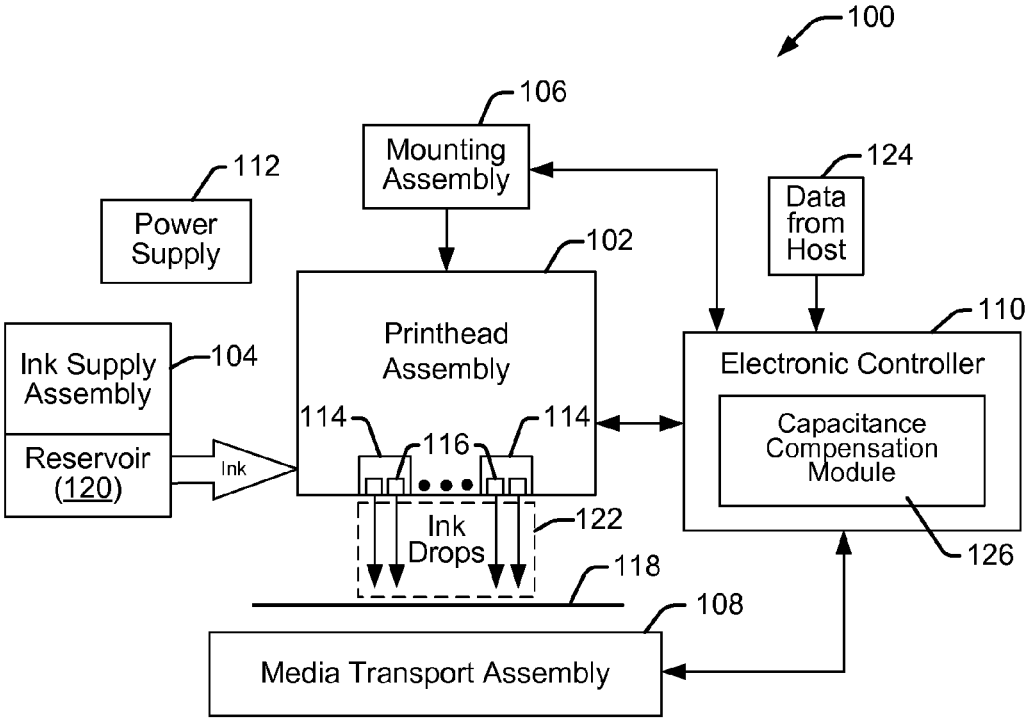
FIG. 1 shows a cross-sectional side view of a piezoelectric fluid ejection assembly, according to an embodiment.

As noted above, long term degradation of piezoelectric elements within and between piezoelectric fluid ejection assemblies (e.g., printheads) can reduce the capacitance of the piezo-elements, resulting in non-uniform performance of the piezo-elements over time. Such degradation can often be seen in non-uniform print patterns that develop in the printed output of piezoelectric inkjet printers over time.

In addition, piezoelectric printheads are sensitive to short term changes in temperature which influence piezoelectric element capacitance. More specifically, the capacitance and pumping strength of a piezoelectric element increases as temperatures rise during normal short term operation (e.g., during a printjob). In addition, fluid viscosity decreases with increasing temperature. The increased pump strength and lower fluid viscosity caused by increases in temperature in piezoelectric printheads result in higher fluid drop weights and velocities, which adversely affect printer performance.

Normal operating currents used to drive piezo-elements produce enough heat to initiate such increases in temperature. With a fixed drive voltage, the increase in capacitance caused by an increase in temperature results in an increase in the amount of current needed to drive the capacitance. The increased current causes an increase in power drop in the printhead, which produces additional heat that further increases the temperature. This open-loop cycle, if left unchecked, will result in an overheated and ineffective piezoelectric printhead.

Prior methods of managing this problem primarily involve tight control over the fluid (ink) temperature. Increases in temperature are partially managed through normal operation as ejected fluid drops carry away excess heat. Another common way to manage temperature is to circulate ink out of the printhead, through a cooling mechanism, and then back to the printhead. The continual recirculation of ink helps to limit unwanted temperature increases. However, in many circumstances, such as when printing a large print job with a large format inkjet printer, recirculation cooling systems cannot respond quickly enough to control the rising temperature.

Because fluid circulation alone is often not enough to adequately cool ink in printheads, other methods are usually employed either alone or in addition to fluid circulation. One method commonly used is to vary the print modes in the printer. For example, drop burst lengths (i.e., the number of fluid drops fired one after another) can be limited to fewer drops. This method is often coupled with increasing the number of printing passes over the media to account for the decreased drop burst lengths. Another method is to simply increase the number of printheads in the printer. The problem with these methods is that they either decrease printing performance or they increase printing costs, or both.

Embodiments of the present disclosure improve on prior methods of managing increasing temperatures and the more general problem of changing capacitances in piezoelectric printheads through a closed-loop control system and methods that maintain the level of current delivered to each piezoelectric element in a printhead. A circuit monitors the current needed to drive a piezoelectric element and feeds back the monitored current to a drive circuit driving the piezo-element. A controller then controls the drive circuit to limit the current delivered to the piezo-element by adjusting the rise and fall times of the current waveform driving the piezo-element (either by adjusting the amount of resistance in series with piezo-element or by altering the internal resistance of one or more FETs within the drive circuit). Controlling and limiting current to each piezo-element individually within a piezoelectric printhead controls the pumping strength of each piezo-element individually, as well as generally controlling the ink temperature. In this way, uniform performance of each piezo-element (and ink ejection nozzle) is maintained throughout an entire printjob and throughout the life of the element regardless of the changes in capacitance of the piezo-element due to short term, temperature influences or long term degradation. Controlling and limiting the current to a piezo-element controls both the piezo-element pumping strength and the ink temperature.

In one embodiment, a method of compensating for capacitance change in a piezoelectric element of a fluid ejection device includes sensing a current driving a piezoelectric element. From the sensed current, it is determined that the capacitance of the piezoelectric element is changed from an expected value. The rise time of the current driving the piezoelectric element is altered to compensate for the changed capacitance. In one implementation the rise time is increased by increasing a turn-on time of a FET driving the piezoelectric element. In one implementation the rise time is increased by increasing a resistance in series with the piezoelectric element. In one implementation the rise time is decreased by decreasing a turn-on time of a FET driving the piezoelectric element. In one implementation the rise time is decreased by decreasing a resistance in series with the piezoelectric element.

In another embodiment, a system to compensate for changes in capacitance in piezoelectric elements of a fluid ejection device includes a piezoelectric element to pump fluid through a nozzle of a fluid ejection device, and a piezoelectric drive circuit to drive the piezoelectric element. A controller controls operation of the fluid ejection device, and a capacitance compensation application executable by the controller is configured to sense a driving current, calculate a capacitance of the piezoelectric element based on the sensed driving current, and adjust a rise and fall time of the driving current to compensate for the changes in the capacitance.

Illustrative Embodiments

FIG. 1 illustrates a fluid ejection device embodied as an inkjet printing system 100, according to an embodiment of the disclosure. In this embodiment, a fluid ejection assembly is disclosed as a fluid drop jetting printhead 114. Inkjet printing system 100 includes an inkjet printhead assembly 102, an ink supply assembly 104, a mounting assembly 106, a media transport assembly 108, an electronic printer controller 110, and at least one power supply 112 that provides power to the various electrical components of inkjet printing system 100. Inkjet printhead assembly 102 includes at least one fluid ejection assembly 114 (printhead 114) that ejects drops of ink through a plurality of orifices or nozzles 116 toward a print medium 118 so as to print onto print media 118. Print media 118 can be any type of suitable sheet or roll material, such as paper, card stock, transparencies, Mylar, and the like. Nozzles 116 are typically arranged in one or more columns or arrays such that properly sequenced ejection of ink from nozzles 116 causes characters, symbols, and/or other graphics or images to be printed on print media 118 as inkjet printhead assembly 102 and print media 118 are moved relative to each other.

Ink supply assembly 104 supplies fluid ink to printhead assembly 102 and includes a reservoir 120 for storing ink. Ink flows from reservoir 120 to inkjet printhead assembly 102. Ink supply assembly 104 and inkjet printhead assembly 102 can form either a one-way ink delivery system or a macro-recirculating ink delivery system. In a one-way ink delivery system, substantially all of the ink supplied to inkjet printhead assembly 102 is consumed during printing. In a macro-recirculating ink delivery system, however, only a portion of the ink supplied to printhead assembly 102 is consumed during printing. Ink not consumed during printing is returned to ink supply assembly 104.

In one embodiment, inkjet printhead assembly 102 and ink supply assembly 104 are housed together in an inkjet cartridge or pen. In another embodiment, ink supply assembly 104 is separate from inkjet printhead assembly 102 and supplies ink to inkjet printhead assembly 102 through an interface connection, such as a supply tube. In either embodiment, reservoir 120 of ink supply assembly 104 may be removed, replaced, and/or refilled. Where inkjet printhead assembly 102 and ink supply assembly 104 are housed together in an inkjet cartridge, reservoir 120 includes a local reservoir located within the cartridge as well as a larger reservoir located separately from the cartridge. The separate, larger reservoir serves to refill the local reservoir. Accordingly, the separate, larger reservoir and/or the local reservoir may be removed, replaced, and/or refilled.

Mounting assembly 106 positions inkjet printhead assembly 102 relative to media transport assembly 108, and media transport assembly 108 positions print media 118 relative to inkjet printhead assembly 102. Thus, a print zone 122 is defined adjacent to nozzles 116 in an area between inkjet printhead assembly 102 and print media 118. In one embodiment, inkjet printhead assembly 102 is a scanning type printhead assembly. As such, mounting assembly 106 includes a carriage for moving inkjet printhead assembly 102 relative to media transport assembly 108 to scan print media 118. In another embodiment, inkjet printhead assembly 102 is a non-scanning type printhead assembly. As such, mounting assembly 106 fixes inkjet printhead assembly 102 at a prescribed position relative to media transport assembly 108. Thus, media transport assembly 108 positions print media 118 relative to inkjet printhead assembly 102.

Electronic printer controller 110 typically includes a processor, firmware, software, one or more memory components including volatile and no-volatile memory components, and other printer electronics for communicating with and controlling inkjet printhead assembly 102, mounting assembly 106, and media transport assembly 108. Electronic controller 110 receives data 124 from a host system, such as a computer, and temporarily stores data 124 in a memory. Typically, data 124 is sent to inkjet printing system 100 along an electronic, infrared, optical, or other information transfer path. Data 124 represents, for example, a document and/or file to be printed. As such, data 124 forms a print job for inkjet printing system 100 and includes one or more print job commands and/or command parameters.

In one embodiment, electronic printer controller 110 controls inkjet printhead assembly 102 for ejection of ink drops from nozzles 116. Thus, electronic controller 110 defines a pattern of ejected ink drops that form characters, symbols, and/or other graphics or images on print media 118. The pattern of ejected ink drops is determined by the print job commands and/or command parameters. In one embodiment, electronic controller 110 includes capacitance compensation module 126 stored in a memory of controller 110. Capacitance compensation module 126 executes on electronic controller 110 (i.e., a processor of controller 110) to control current sensing and capacitance compensation functions of driver circuits driving piezoelectric elements within fluid ejection assemblies (i.e., printheads) 114. More specifically, controller 110 executes instructions from module 126 to sense the amount of current driving a piezoelectric element in a printhead 114, calculate a capacitance of the piezoelectric element, and compensate for changes in capacitance by adjusting rise and fall times of the current waveform driving the piezoelectric element.

In one embodiment, inkjet printing system 100 is a drop-on-demand piezoelectric inkjet printing system wherein the fluid ejection assembly 114 is a piezoelectric inkjet (PIJ) printhead 114 that employs a piezoelectric material actuator as an ejection element to generate pressure pulses that force ink drops out of a nozzle 116. In one implementation, inkjet printhead assembly 102 includes a single piezoelectric inkjet (PIJ) printhead 114. In another implementation, inkjet printhead assembly 102 includes a wide array of piezoelectric inkjet (PIJ) printheads 114.

Figure 2:
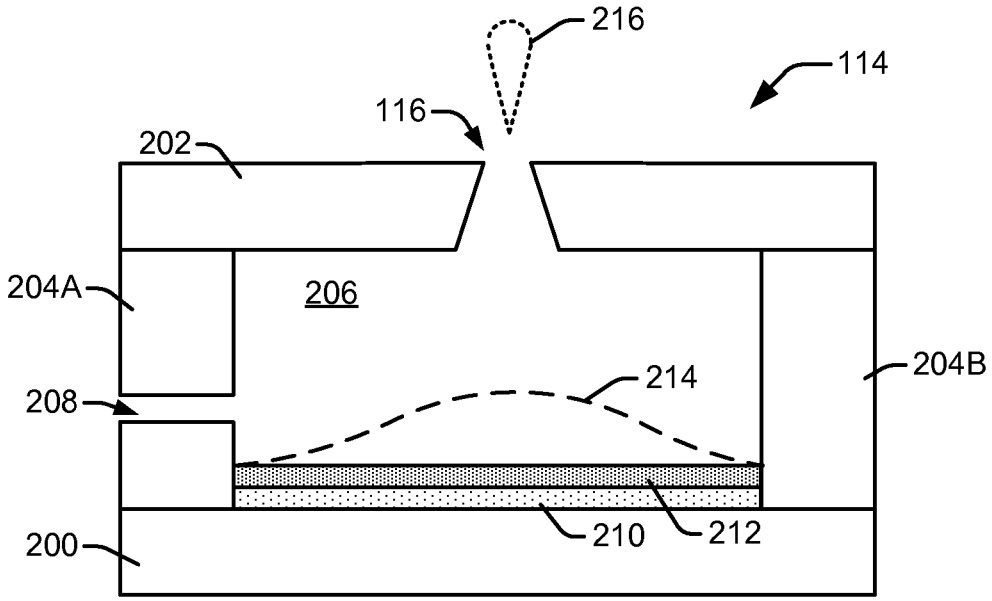
FIG. 2 shows a partial cross-sectional side view of an example piezoelectric inkjet (PIJ) printhead assembly, according to an embodiment.

FIG. 2 shows a partial cross-sectional side view of an example piezoelectric inkjet (PIJ) printhead assembly 114, according to an embodiment of the disclosure. The partial printhead 114 shown includes a rigid floor 200 and a rigid top nozzle plate 202 having a nozzle outlet 116 through which ink or other fluid droplets are ejected. The assembly also includes a number of sidewalls 204A and 204B, collectively referred to as sidewalls 204. The sidewalls 204 separate the floor 200 from the nozzle plate 202. The rigid floor 200, the nozzle plate 202, and the sidewalls 204 define a fluid chamber 206 to contain ink or other fluid before and after an ejection of droplets of ink through the nozzle outlet 116. Sidewall 204A has a fluid inlet 208 to receive the ink that eventually gets ejected as droplets through nozzle outlet 116. The placement of fluid inlet 208 is not limited to sidewall 204A. In different embodiments, for example, fluid inlet 208 may be placed in other sidewalls 204 or in the floor 200, or it may include multiple fluid inlets placed in various sidewalls 204 and/or the floor 200.

At the floor 200 of the chamber 206 is a piezoelectric element 210 such as a piezoceramic thin film sheet (e.g., PZT—lead zirconate titanate). The piezoelectric element 210 is typically covered by a flexible membrane 212. Drop ejection occurs upon activation of the piezoelectric element 210 through application of a voltage across the element 210. Activation of the piezoelectric element 210 causes the element to deform, which results in a corresponding displacement of the adjoining membrane 212 into the chamber area 206 as shown by the dotted line 214 in FIG. 2 (the amount of displacement shown by the dotted line 214 is exaggerated for the purpose of this description). Displacement of the membrane 212 into the chamber 206 reduces the chamber volume, causing the ejection of a droplet 216 of ink or other fluid from the chamber 206 and through the nozzle 116.

Figure 3:
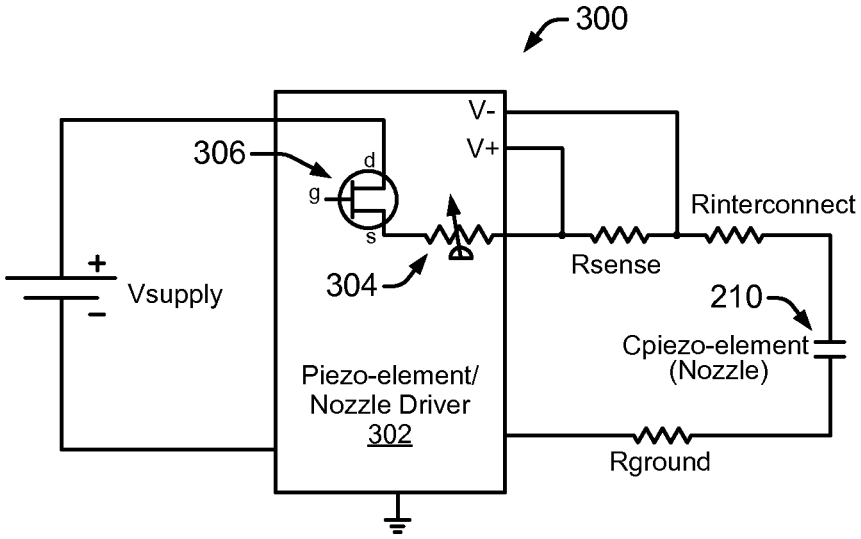
FIG. 3 shows a current monitor circuit to supply and monitor current to a piezoelectric element, according to an embodiment.

FIG. 3 shows a current monitor circuit 300 to supply and monitor current to a piezoelectric element 210, according to an embodiment of the disclosure. Current monitor circuit 300 includes a piezoelectric element driver circuit 302 to supply current to a piezo-element 210 (shown as capacitance Cpiezo-element 210) through a sensor resistor (Rsense), and interconnect resistor (Rinterconnect). Rinterconnect represents resistance that naturally occurs in the interconnects between the drive circuit 302 and the piezo-element 210, while Rsense is a resistance whose value is known and predetermined. Rground is the resistance between the piezo-element 210 capacitance (Cpiezo-element 210) and ground. Drive circuit 302 has internal circuitry that includes, for example, one or more pull-up and pull-down FETs supplied by a voltage source (e.g., Vsupply) to drive piezo-element 210. FET 306 is an example drive FET shown for the purpose of illustration only, and not for the purpose of providing a complete circuit diagram of the circuitry within drive circuit 302. Likewise, drive circuit 302 includes variable resistor 304 in series between Vsupply and piezo-element 210. Variable resistor 304 is also shown for the purpose of illustration only, and not for the purpose of providing a complete circuit diagram of the circuitry within drive circuit 302.

Drive circuit 302 monitors current supplied to piezoelectric element 210 through Rsense. The V+ and V− inputs of drive circuit 302 detect voltage drop across Rsense. Based on the value of Rsense and the voltage across Rsense as sensed at inputs V+ and V−, the current through Rsense (and through piezo-element 210) is determined. Current is determined, for example, by controller 110 according to executable instructions from a capacitance compensation module 126. The capacitance compensation module 126 is further configured to calculate the capacitance of piezo-element 210 based on the current calculated through Rsense and piezo-element 210. Capacitance compensation module 126 can determine if capacitance of the piezo-element 210 has changed from an expected value (e.g., due to short term temperature change or long term degradation). Based on a change in the capacitance from an expected value, capacitance compensation module 126 is configured to adjust current flow to the piezo-element 210 to compensate for the changed capacitance. Adjusting current to piezo-element 210 is achieved by altering the waveforms (i.e., altering rise and fall times) from drive circuit 302 that drive piezo-element 210. Capacitance compensation module 126 can adjust rise and fall times of drive waveforms by changing the amount of resistance in series with piezo-element 210 through variable resistor 304, or by altering the internal resistance of one or more FETs 306. Adjusting rise and fall times of waveforms driving piezo-element 210 is discussed in more detail with respect to FIG. 4 below.

Figure 4:
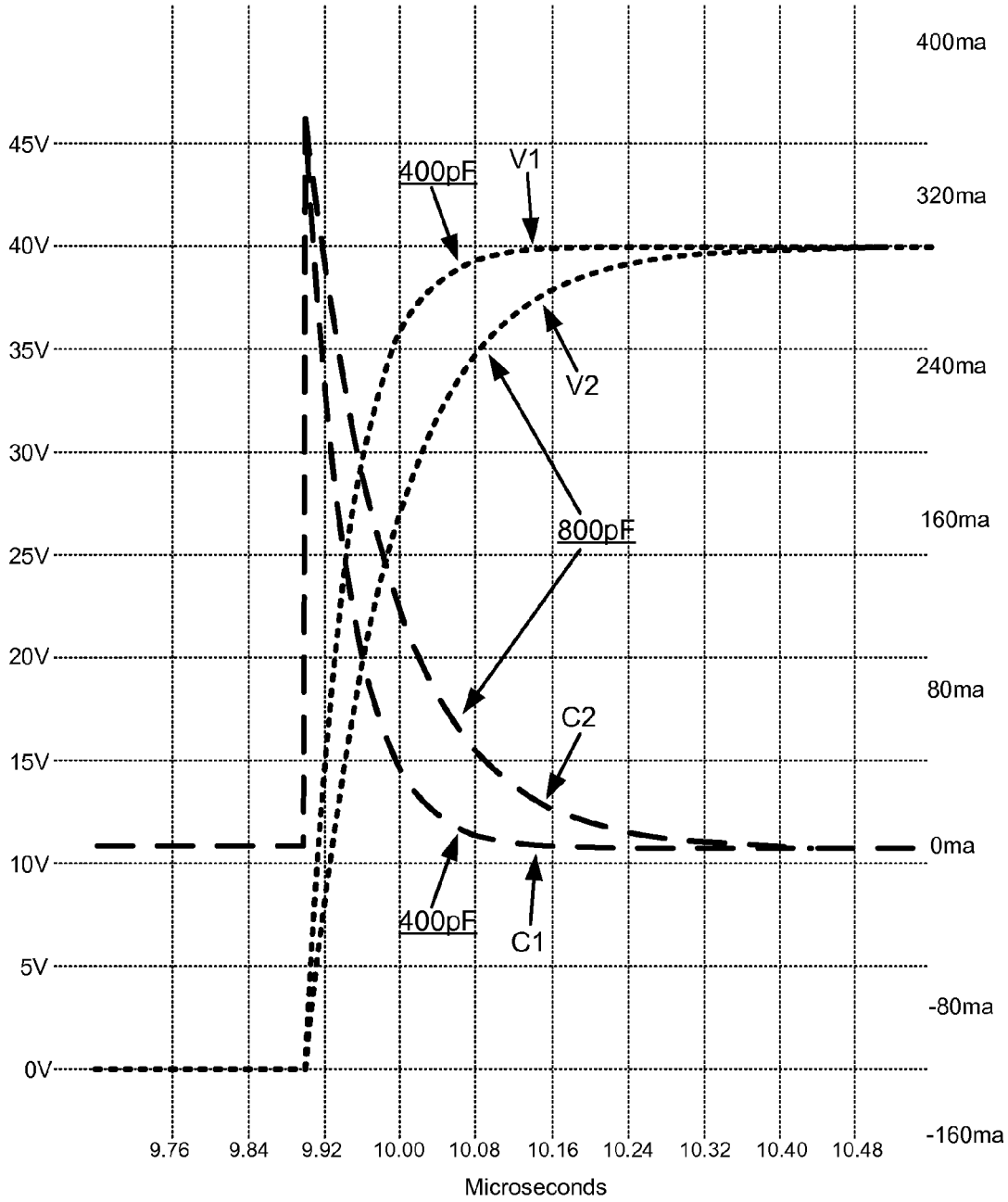
FIG. 4 shows example plots of current and voltage drive waveforms produced when driving a capacitance such as in a capacitive piezo-element for different values of capacitance, according to an embodiment.

FIG. 4 shows example plots of current and voltage drive waveforms produced when driving a capacitance such as in the capacitive piezo-element 210 (Cpiezo-element 210) for different values of capacitance, according to an embodiment of the disclosure. The example plots (C and V) illustrate how the current and voltage drive waveforms change for a piezo-element 210 whose capacitance changes, for example, due to changes in temperature or due to degradation of the piezo-element 210 over time. For example, during operation of a piezoelectric inkjet printhead 114, the current driving the piezo-element 210 creates a power drop across the element that causes a rise in temperature. The rise in temperature causes an increase in the capacitance of the piezo-element 210, which in turn causes an increase in the current that drives the element. That is, for a fixed voltage, as capacitance increases, the current increases according to the equation:

$$I=C(dv/dt)$$

This rise in current can be seen in the example plots shown in FIG. 4. In these plots, capacitance is shown to rise from 400 picofarads, which is a typical example value for the capacitive piezo-element 210 (Cpiezo-element 210) in an initial (i.e., cold) state, to 800 picofarads, which is an example value for the capacitive piezo-element 210 as temperature increases.

In operation, one or more FETs within driver circuit 302 (FIG. 3) turn on to apply the source voltage (Vsupply) across the piezo-element 210 and series resistors (Rsense, Rinterconnect). Together, the piezo-element 210 and series resistors (Rsense, Rinterconnect) make up an RC series circuit. Plots C (C1, C2) of FIG. 4 represent the charging current in the capacitive piezo-element 210 (Cpiezo-element 210) for the two values noted (i.e., 400 pF, 800 pF). Initially (e.g., at approximately 9.90 microseconds), the charging current is at maximum. As time passes, there is a continuous decrease in current flowing into the capacitive piezo-element 210. The decreasing flow is caused by the voltage buildup across the piezo-element 210. As the capacitive piezo-element 210 reaches its full charge, the current flowing in the element 210 stops (e.g., at approximately 10.48 microseconds).

Plots V (V1, V2) represent the voltage developed across the capacitive piezo-element 210 (Cpiezo-element 210) for the two values noted (i.e., 400 pF, 800 pF). Initially (e.g., at approximately 9.90 microseconds), maximum current flows through the series resistors (Rsense, Rinterconnect), and the entire circuit voltage is dropped across these resistors. The voltage across the capacitive piezo-element 210 is initially at zero volts. As time passes, the decreasing current causes less and less voltage to be dropped across the series resistors (Rsense, Rinterconnect), and more voltage to drop across the capacitive piezo-element 210. As the capacitive piezo-element 210 reaches its full charge and the current flowing in the capacitive element stops (e.g., at approximately 10.48 microseconds), the voltage drop across the capacitive piezo-element 210 is equal to the source voltage (Vsupply), and the voltage dropped across the series resistors (Rsense, Rinterconnect) is equal to zero. Thus, plots C and V of FIG. 4 represent a complete charge cycle of the capacitive piezo-element 210 (Cpiezo-element 210).

As noted above, an increase in capacitance from an increasing temperature causes an increase in current (i.e., a change in the current waveform), which increases the strength of the pumping action of the piezoelectric element 210. The increased pumping strength coupled with the lower fluid viscosity of the ink (also caused by the higher temperature) results in higher fluid drop weights and velocities, which adversely affect printer performance. Accordingly, current changes as shown in plots C of FIG. 4 provide a means for detecting changes in capacitance of the piezoelectric element 210 during operation. In addition, piezoelectric elements 210 degrade as they age, and the value of their capacitance decreases. Such decreases in capacitance from degradation are also detectable through similar but opposite current changes as those shown in plots C of FIG. 4.

Figure 5:
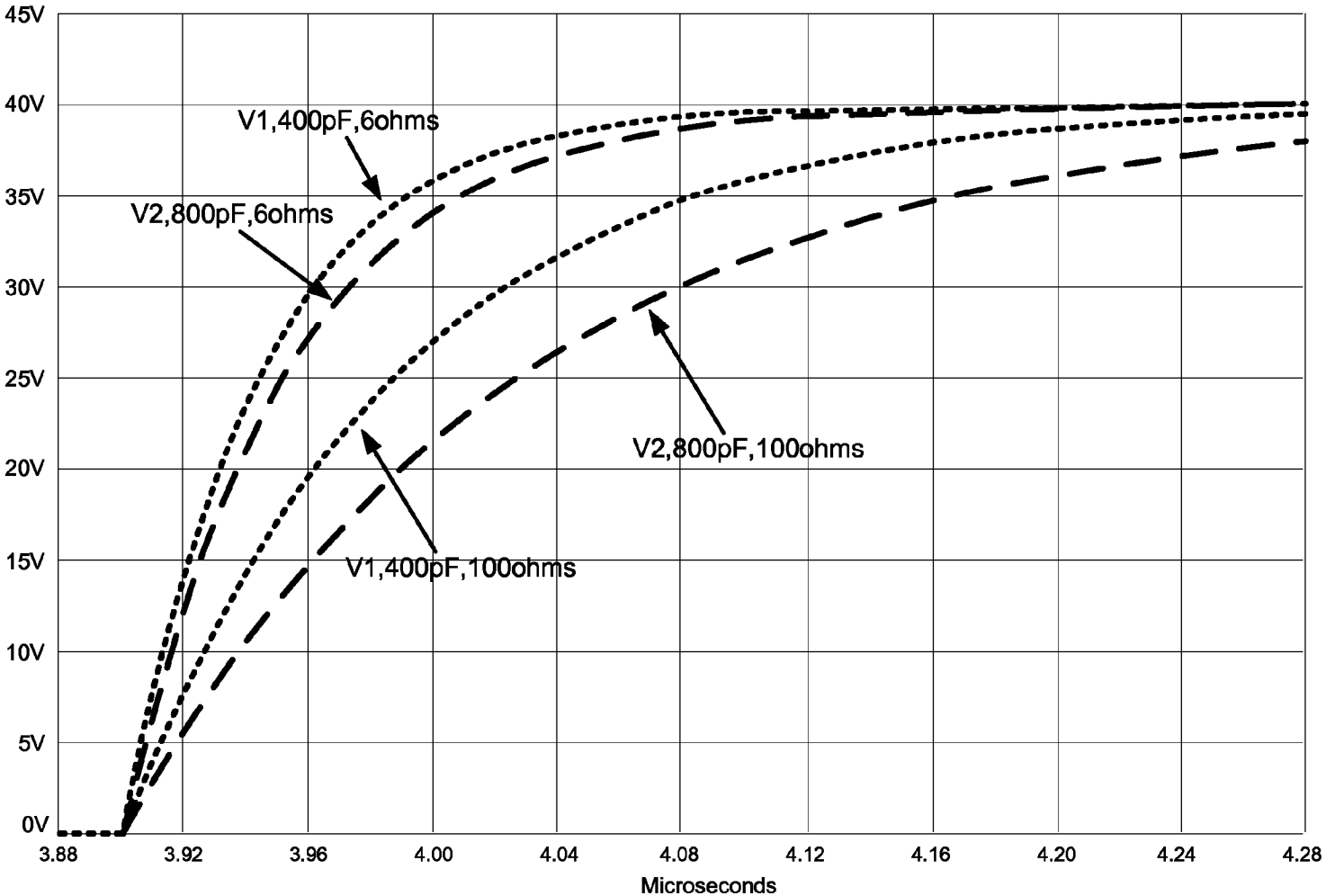
FIG. 5 shows example plots of voltage drive waveforms produced when driving a capacitance such as a capacitive piezo-element for different values of capacitance, according to an embodiment.

FIG. 5 shows example plots of voltage drive waveforms produced when driving a capacitance such as capacitive piezo-element 210 (Cpiezo-element 210) for different values of capacitance, according to an embodiment of the disclosure. The example plots illustrate how introducing additional resistance in series with the piezo-element 210 through a variable resistor 304, for example, alters the drive waveform. Thus, it is seen how a change in capacitance of a capacitive piezo-element 210 can be compensated to reduce the current that drives the piezo-element 210.

As shown in FIG. 5, voltage drive waveform V1 is generated for a value of capacitance in capacitive piezo-element 210 of 400 picofarads. V1 is shown first as being generated using a variable resistance 304 value of 6 ohms. V1 is also generated using a variable resistance 304 value of 100 ohms. From the V1 waveforms it is apparent that as additional resistance is introduced through a variable resistor 304, the voltage waveform rise time increases. The increased voltage rise time across the capacitive piezo-element 210 indicates that additional voltage is being dropped across the series resistors (Rsense, Rinterconnect, and variable resistor 304) and that a reduced (or less sharp) current waveform is charging the capacitive piezo-element 210 more slowly. With reduced current charging the piezo-element, less energy is dropped across the piezo-element 210, which brings down the temperature and the pumping strength of the element 210, thus compensating for the previous increase in capacitance.

FIG. 5 also includes voltage drive waveform V2, generated for a value of capacitance in capacitive piezo-element 210 of 800 picofarads. V2 is shown first as being generated using a variable resistance 304 value of 6 ohms. V2 is also generated using a variable resistance 304 value of 100 ohms. From the V2 waveforms it is apparent that as additional resistance is introduced through a variable resistor 304, the voltage waveform rise time increases. The increased voltage rise time across the capacitive piezo-element 210 indicates that additional voltage is being dropped across the series resistors (Rsense, Rinterconnect, and variable resistor 304) and that a reduced (or less sharp) current waveform is charging the capacitive piezo-element 210 more slowly. With reduced current charging the piezo-element, less energy is dropped across the piezo-element 210, which brings down the temperature and the pumping strength of the element 210, thus compensating for the previous increase in capacitance.

Although FIG. 5 indicates changes in voltage drive waveforms are made by introducing resistance through a variable resistor 304, changes in the drive waveforms (e.g., increasing rise time) can also be implemented through manipulating the turn-on time of the drive FET 306 in drive circuit 302. Adjusting the turn-on time of the FET 306 effectively adjusts the internal resistance of the FET. Thus, the effect of increasing the rise time of the voltage waveform as shown in FIG. 5 can also be achieved by adjusting turn-on times of the drive FET 306. The result is again, that less energy drops across the piezo-element 210 which brings down the temperature and the pumping strength of the element 210. FET turn-on time can be adjusted in a number of ways as are known to those skilled in the art. For example, decreasing the gate voltage of the FET increases the turn-on time. Putting an inductance in series with the FET gate slows down the charge being delivered to the gate which also slows down the turn-on and turn-off times of the FET.

Figure 6:
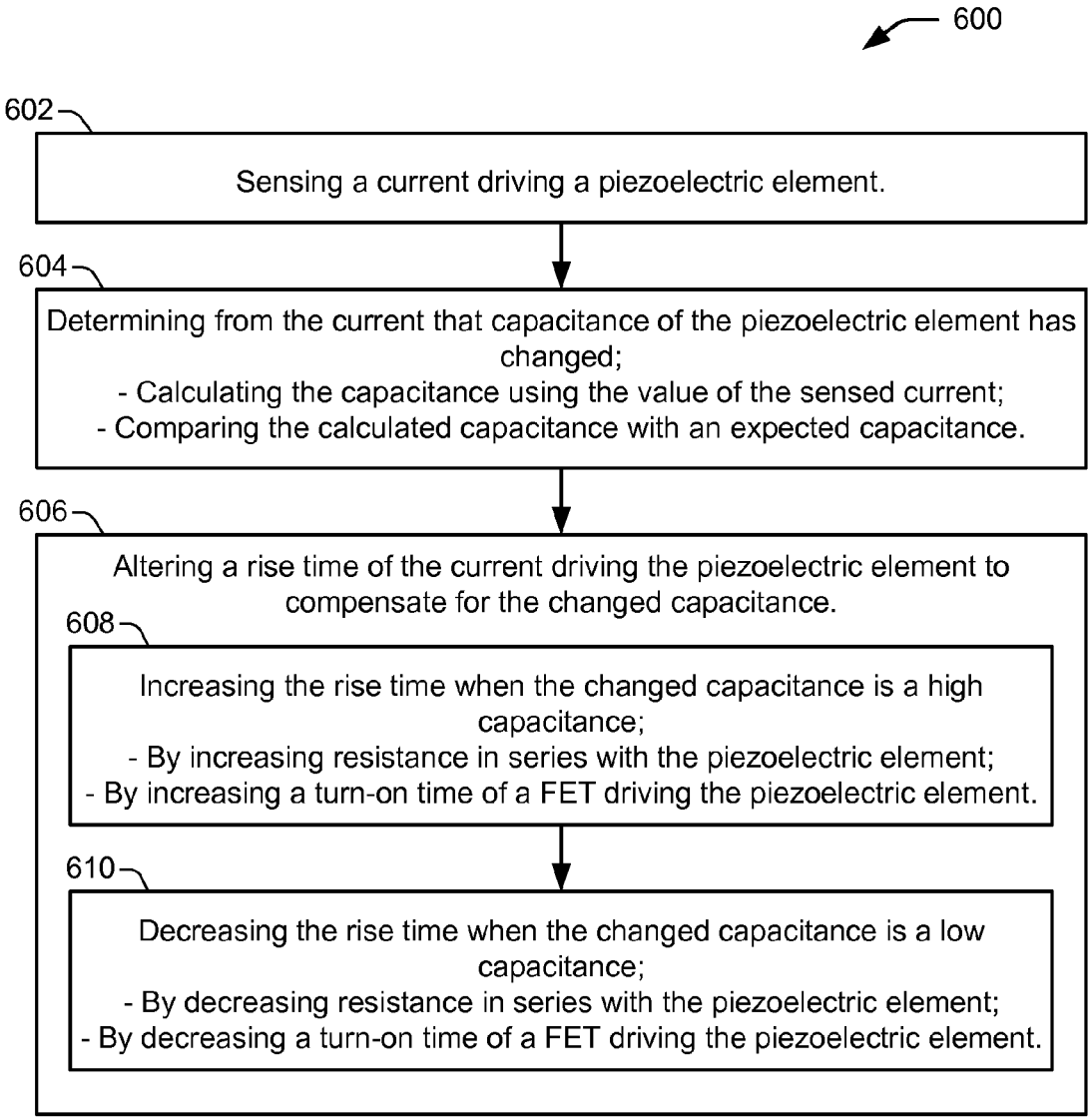
FIG. 6 shows a flowchart of an example method of compensating for capacitance change in a piezoelectric element of a fluid ejection device, according to an embodiment.

FIG. 6 shows a flowchart of an example method 600 of compensating for capacitance change in a piezoelectric element of a fluid ejection device (e.g., printhead), according to an embodiment of the disclosure. Method 600 is associated with the embodiments of an inkjet printing system 100 and fluid ejection device having a system to compensate for changes in capacitance in piezoelectric elements discussed above with respect to illustrations in FIGS. 1-5.

Method 600 begins at block 602 with sensing a current driving a piezoelectric element. At block 604 the sensed current is used to determine that the capacitance of the piezoelectric element has changed. Determining that the capacitance of the piezoelectric element has changed includes calculating the capacitance using the value of the sensed current, and comparing the calculated capacitance with an expected capacitance.

The method 600 continues at block 606 with altering a rise time of the current that is driving the piezoelectric element to compensate for the changed capacitance. As shown in block 608, altering the rise time of the current can include increasing the rise time when the changed capacitance is a high capacitance. Increasing the rise time can be accomplished, for example, by increasing the amount of resistance in series with the piezoelectric element (e.g., by adjusting a variable resistor), or by increasing a turn-on time of a FET driving the piezoelectric element (e.g., by decreasing gate voltage of the FET, or placing and inductor in series with the gate of the FET to slow down the charge being delivered to the gate).

As shown in block 610, altering the rise time of the current can include decreasing the rise time when the changed capacitance is a low capacitance. Decreasing the rise time can be accomplished, for example, by decreasing the amount of resistance in series with the piezoelectric element (e.g., by adjusting a variable resistor), or by decreasing a turn-on time of a FET driving the piezoelectric element (e.g., by increasing gate voltage of the FET).

What is claimed is:

1. A method of compensating for capacitance change in a piezoelectric element of a fluid ejection device, comprising:

sensing a current driving a piezoelectric element;

determining from the current that capacitance of the piezoelectric element has changed; and altering a rise time of the current driving the piezoelectric element to compensate for the changed capacitance.

2. A method as recited in claim 1, wherein the changed capacitance is a high capacitance, and altering the rise time of the current driving the piezoelectric element comprises increasing the rise time.

3. A method as recited in claim 2, wherein increasing the rise time comprises increasing a resistance in series with the piezoelectric element.

4. A method as recited in claim 2, wherein increasing the rise time comprises increasing a turn-on time of a FET driving the piezoelectric element.

5. A method as recited in claim 4, wherein increasing the turn-on time of the FET comprises decreasing gate voltage of the FET.

6. A method as recited in claim 4, wherein increasing the turn-on time of the FET comprises including an inductor in series with the gate of the FET to slow down the charge being delivered to the gate.

7. A method as recited in claim 1, wherein the changed capacitance is a low capacitance, and altering the rise time of the current driving the piezoelectric element comprises decreasing the rise time.

8. A method as recited in claim 7, wherein decreasing the rise time comprises decreasing a resistance in series with the piezoelectric element.

9. A method as recited in claim 7, wherein decreasing the rise time comprises decreasing a turn-on time of a FET driving the piezoelectric element.

10. A method as recited in claim 9, wherein decreasing the turn-on time of the FET comprises increasing gate voltage of FET.

11. A method as recited in claim 1, wherein determining that the capacitance has changed comprises:

calculating the capacitance using the value of the sensed current; and comparing the calculated capacitance with an expected capacitance.

12. A system to compensate for changes in capacitance in piezoelectric elements of a fluid ejection device, comprising:

a piezoelectric element to pump fluid through a nozzle of a fluid ejection device;

a drive circuit to drive the piezoelectric element;

a sense resistor in series between the drive circuit and the piezoelectric element to monitor current to the piezoelectric element and to feedback current information to the drive circuit;

a capacitance compensator internal to the drive circuit to alter the current to the piezoelectric element based on the current information.

13. A system as in claim 12, wherein the capacitance compensator comprises a variable resistor in series with the piezoelectric element configured to increase when the current is too high and decrease when the current is too low.

14. A system as in claim 12, wherein the capacitance compensator comprises a drive FET configured to alter rise and fall times of the current to the piezoelectric element based on the current information.

15. A system as in claim 14, wherein the drive FET is configured to vary turn-on and turn-off times to alter the rise and fall times of the current.

16. A system as in claim 12, further comprising:

a controller to control operation of the fluid ejection device; and a capacitance compensation module executable by the controller to calculate a capacitance of the piezoelectric element based on the current, and to adjust a rise and fall time of the current to compensate for the changes in the capacitance.

17. A system as in claim 12, further comprising a FET driver in the piezoelectric drive circuit, the FET driver controllable by the controller to adjust the rise and fall time of the driving current.

18. A system as in claim 12, further comprising an adjustable series resistance in the piezoelectric drive circuit, the adjustable series resistance controllable by the controller to adjust the rise and fall time of the driving current.

* * * * *